US006557735B1

(12) United States Patent
Stray

(10) Patent No.: US 6,557,735 B1
(45) Date of Patent: May 6, 2003

(54) ADAPTER FOR USE IN CONNECTION WITH COMBINED COOLERS AND DISPENSERS FOR LIQUIDS, PARTICULARLY WATER

(75) Inventor: Jens Stray, Kristiansand (NO)

(73) Assignee: Biogreen A/S (NO)

( * ) Notice: Subject to any disclaimer, the term of this patent is extended or adjusted under 35 U.S.C. 154(b) by 0 days.

(21) Appl. No.: 09/980,053

(22) PCT Filed: Feb. 28, 2000

(86) PCT No.: PCT/NO00/00069

§ 371 (c)(1),
(2), (4) Date: Jan. 16, 2002

(87) PCT Pub. No.: WO00/78666

PCT Pub. Date: Dec. 28, 2000

(30) Foreign Application Priority Data

Jun. 21, 1999 (NO) ..... 19993041

(51) Int. Cl.[7] ..... B67D 5/06
(52) U.S. Cl. ..... 222/185.1; 222/527; 222/564
(58) Field of Search ..... 222/105, 146.6, 222/185.1, 527, 564

(56) References Cited

U.S. PATENT DOCUMENTS 3,060,703 A 10/1962 Benua et al.
3,848,776 A * 11/1974 Schieser ..... 222/105
5,009,028 A * 4/1991 Lorenzana et al. ..... 119/77
5,397,031 A * 3/1995 Jensen ..... 222/146.5
5,964,376 A * 10/1999 Kenosha ..... 222/1
6,098,844 A * 8/2000 Nicolle ..... 222/105
6,123,232 A * 9/2000 Donselman et al. ..... 141/364
6,427,730 B2 * 8/2002 Nagel et al. ..... 141/7

FOREIGN PATENT DOCUMENTS

WO 9307084 4/1993

* cited by examiner

*Primary Examiner*—Joseph A. Kaufman
(74) *Attorney, Agent, or Firm*—Muserlian, Lucas and Mercanti

(57) ABSTRACT

The invention relates to an adapter in connection with combined coolers and dispensers for liquids, particularly drinking water, which coolers and dispensers are intended for receiving a bottle-shaped container placed bottom-up on the top of the combined cooler and dispenser. The adapter comprises a support for supporting a container for a liquid, a chamber extending downwardly from the support, the chamber having an opening in its wall, a lower part with a bottom, a vertical pipe arranged in the bottom of the lower part of the adapter, which pipe is open or can be opened at its lower end and is closed at its upper end and which at its upper part has a flange which is open towards the inside of the pipe, the flange being intended to be connected to a flexible hose between the flange and the container which is to be placed in the adapter and where the vertical pipe is intended to communicate with the pipe system in the combined cooler and dispenser.

5 Claims, 5 Drawing Sheets

Figure 1:
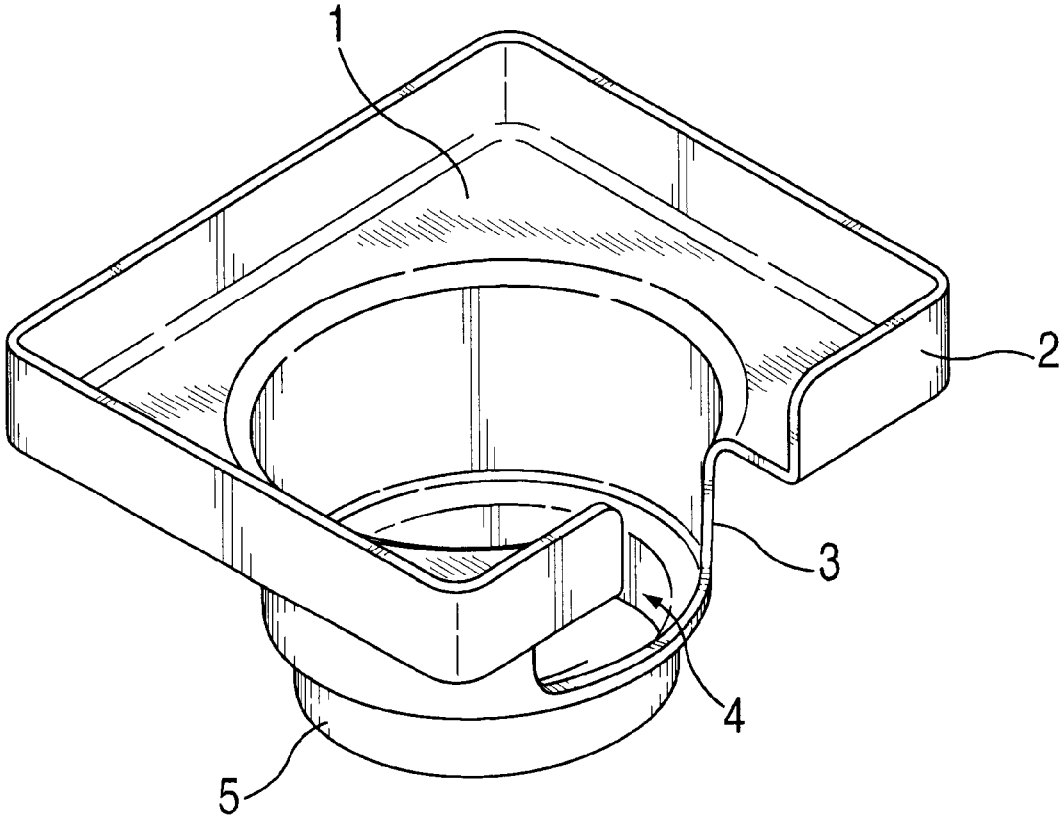

ADAPTER FOR USE IN CONNECTION WITH COMBINED COOLERS AND DISPENSERS FOR LIQUIDS, PARTICULARLY WATER

FIELD OF INVENTION

The present invention relates to an adapter for use in connection with combined coolers and dispensers for liquids, particularly water.

BACKGROUND ART

In the later years a number of offices, private and public institutions, hotels, ships etc. have installed combined coolers and dispensers for drinking water and for other types of drinks. One kind of such combined coolers and dispensers comprises a unit where a rather large bottle-shaped container is placed bottom up on the top of the combine cooler and dispenser. The bottle-shaped container has a standardized shape and a volume of 5 gallons (18.9 liters). The upper part of the combined cooler and dispenser unit has a downwardly extending top surface with an opening in its centre with a shape corresponding to the outer bottleneck part of the bottle-shaped standardized container. When the container is placed on the top of the combined cooler and dispenser unit, the container is thus supported by the top surface of the combined cooler and dispenser. In the outlet of the container there is arranged a valve which automatically opens when the container is placed bottom-up on the top of the combined cooler and dispenser. When the valve in the outlet opening of the container is in open position, the inner volume of the container will communicate with a reservoir in the cooling unit and with the dispensing unit where water can be tapped into drinking cups or the like.

When using the above mentioned standardized bottle-shaped container, water tapped from the container has to be substituted by air. Air is supplied to the container as water is being tapped from the dispensing unit. It has, however, been found that by using this kind of container, the air supplied to the container may contain bacteria and as the container which its content is normally kept at room temperature, the bacteria which enters the container may multiply in number and may give rise to infections when drinking the water. Further, the use of bottle-shaped containers are not very efficient for transport and storage, as such containers occupy far more space than for instance brick-shaped containers.

DISCLOSURE OF INVENTION

It an object of the present invention to provide an adapter for use in connection with the above described combined cooling and dispensing units, which will allow use of other kinds of containers than the standardized bottle-shaped containers described above. It is further an object of the present invention to provide an adapter which allows the use of containers where supply of air to the container is not needed.

Accordingly the present invention relates to an adapter for use in connection with combined coolers and dispensers for liquids, particularly drinking water, which coolers and dispensers are intended for receiving a bottle-shaped container placed bottom-up on the top of the combined cooler and dispenser, said adapter comprising a support for supporting a container for a liquid, a chamber extending downwardly from the support, said chamber having an opening in its wall, a lower part intended to be supported by the combined cooler and dispensing unit, a vertical pipe arranged in the bottom part which pipe is closed at its upper end and is closable or open at its lower end, and on its upper part has a flange which is open towards the inside of the pipe, said flange being intended to be connected to a flexible hose connecting the pipe to a container intended to be placed in the support of the adapter and where the lower part of the vertical pipe is intended to communicate with a reservoir and with the to the pipe system in the combined cooler and dispenser.

The support of the adapter can have many different shapes and can be made to receive containers of different shapes and sizes. It is, however, preferred that the support has a rectangular or square cross-section.

The adapter according to the present invention is particularly useful for containers comprising a reasonable stiff outer container having an inner flexible container made from soft plastic such that the inner container collapses as liquid is tapped from the container. The adapter according to the present invention can further be used for containers having its outlet opening in the bottom of the container.

According to a preferred embodiment of the adapter according to the present invention the vertical pipe is rigidly affixed to the bottom of the lower part of the adapter, and the lower part of the vertical pipe is in this embodiment equipped with a valve which by means of a floating disk arranged in the reservoir of the combined cooler and dispenser, is intended to close the outlet opening of the vertical pipe when the reservoir is filled with water and to open when water is being tapped from the reservoir.

According to another embodiment of the adapter according to the present invention the vertical pipe is arranged vertically movable in the bottom part of the lower part of the adapter and where the vertical pipe is intended to be moved downwardly in vertical direction in order to connect the vertical pipe to the pipe system in the combined cooler and dispenser.

The adapter according to the present invention is preferably affixed to the combined cooling and dispenser by means of a mechanical fastening means such as a screw connection or the like in order to make sure that the adapter can not move in relation to the combined cooler and dispenser.

By the use of the adapter according to the present invention, the adapter is placed on the top of the combined cooler and dispenser. Thereafter a container is placed in the support of the adapter. A flexible hose which is connected to the bottom of the container is thereafter connected to the flange of the pipe arranged in the lower part of the adapter. The opening in the sidewall of the chamber below the support of the adapter makes space for manual connection of the hose to the flange. For an adapter according to the preferred embodiment of the invention, the valve in the bottom of the vertical pipe will now be in open position and water can flow from the container to the reservoir in the combined cooler and dispenser until the floating disk arranged in the reservoir closes the valve. Further water will thereafter only flow from the container to the reservoir when water is being tapped form the combined cooler and dispenser.

For an adapter according to the second embodiment of the invention, the vertical movable pipe is pressed downwards until connection is obtained between the pipe and the pipe system in the combined cooler and dispenser thereby allowing flow of water from the container to the cooler unit and further to the dispensing unit in the combined cooler and dispenser.

As water is being tapped from the dispenser, the flexible inner container placed inside the stiff container will collapse. Return air can thus not pass into the inner flexible container and the possibility of transport of bacteria to the water in the container has been eliminated. When the inner container has been emptied, the flexible hose is disconnected from the flange of the vertical pipe and the empty container can be removed from the support of the adapter and a new container can be installed.

In addition to eliminating supply of bacteria to the water, the adapter according to the present invention makes it possible to use containers regardless of the shape of the container, such as for instance prism-shaped containers or cube-shaped containers. Containers having such a shape are much more efficient to transport and to store than conventional bottle-shaped container as they require less space for the same container volume.

SHORT DESCRIPTION OF THE DRAWINGS

Figure 2:
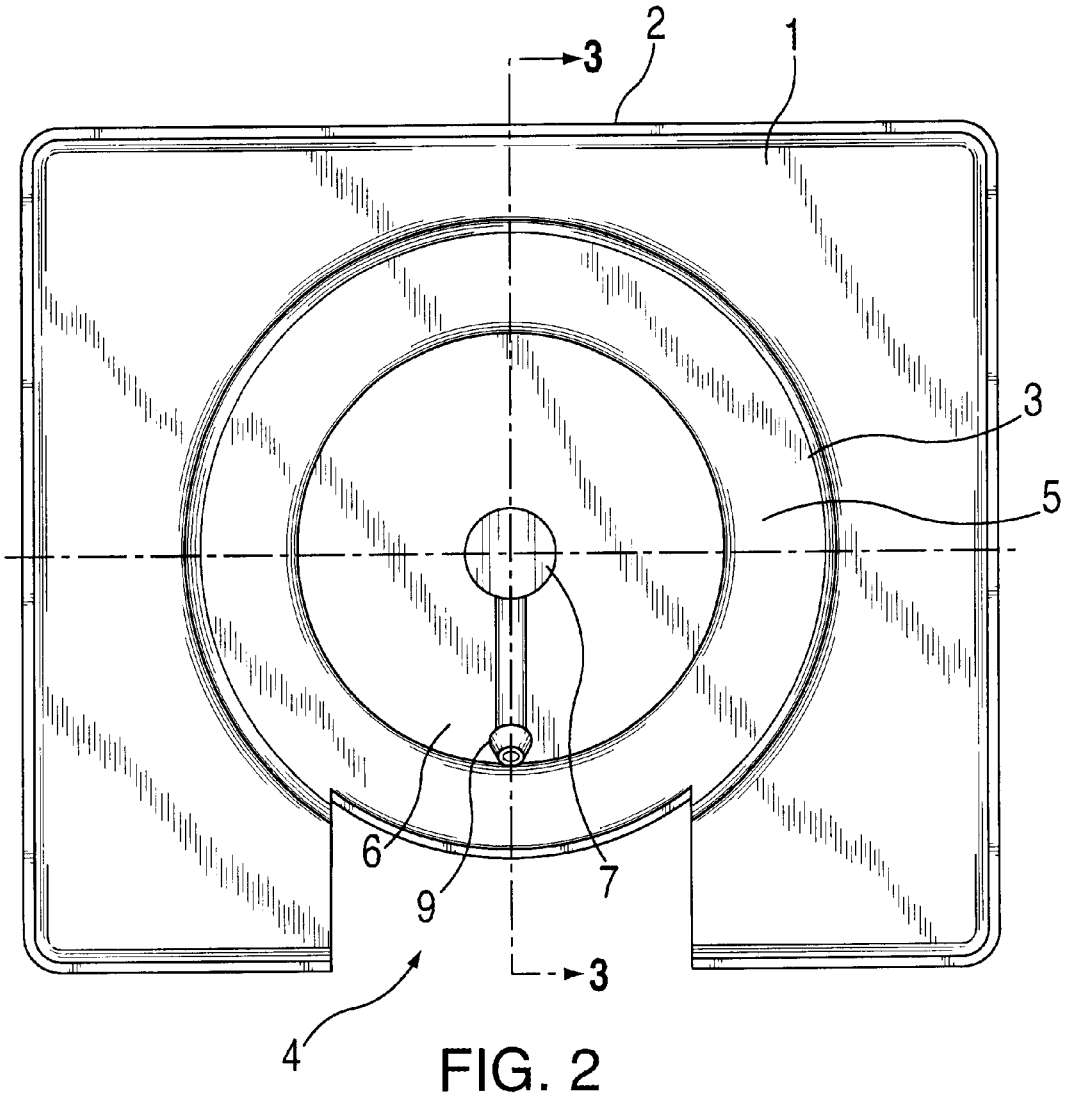
Figure 3:
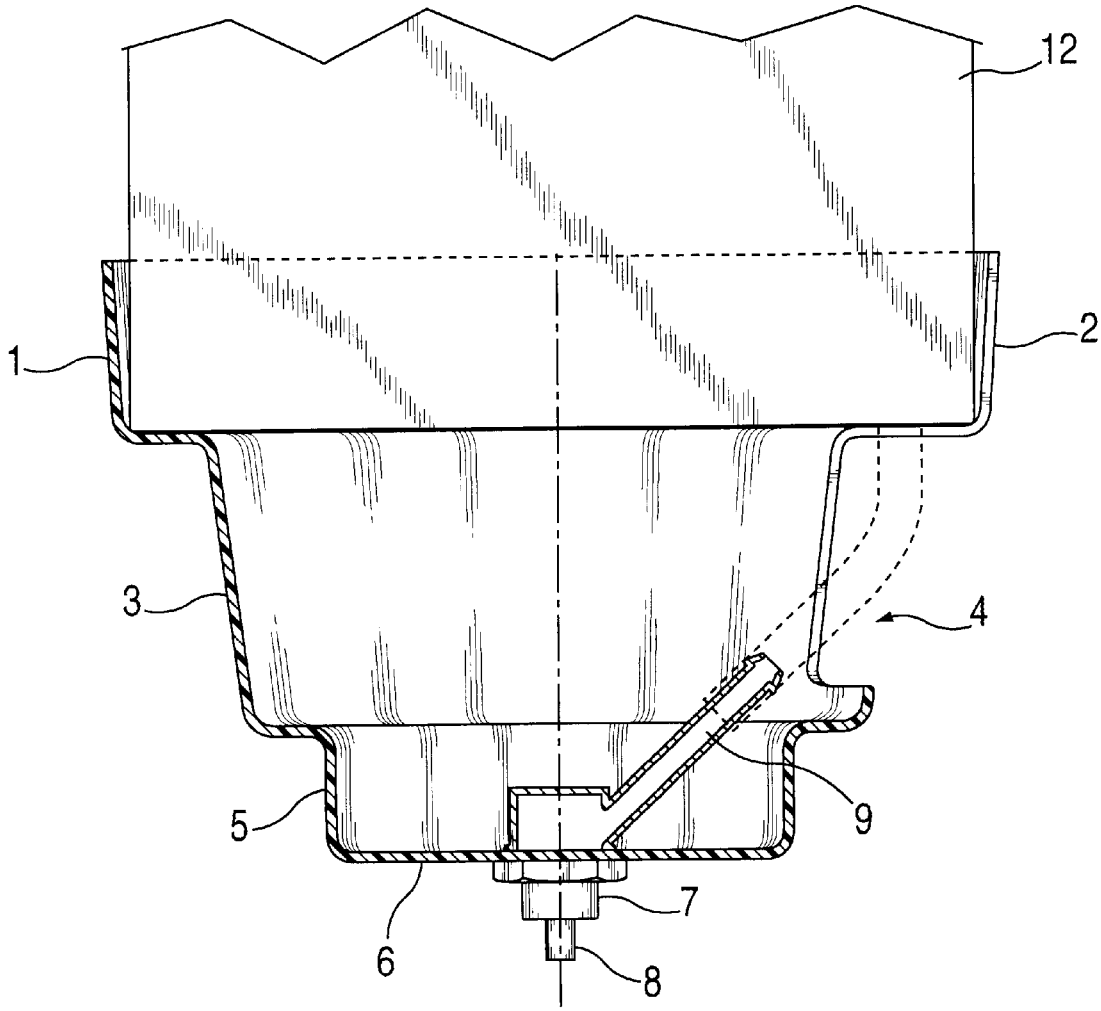
Figure 4:
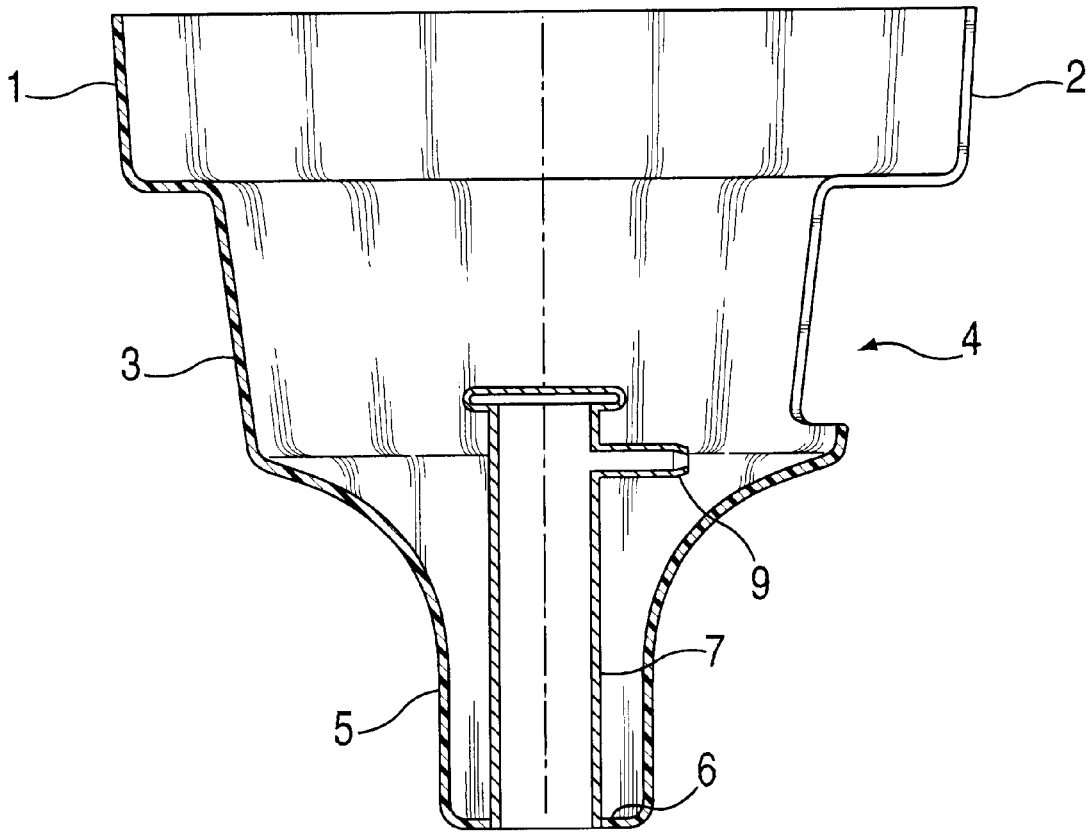
Figure 5:
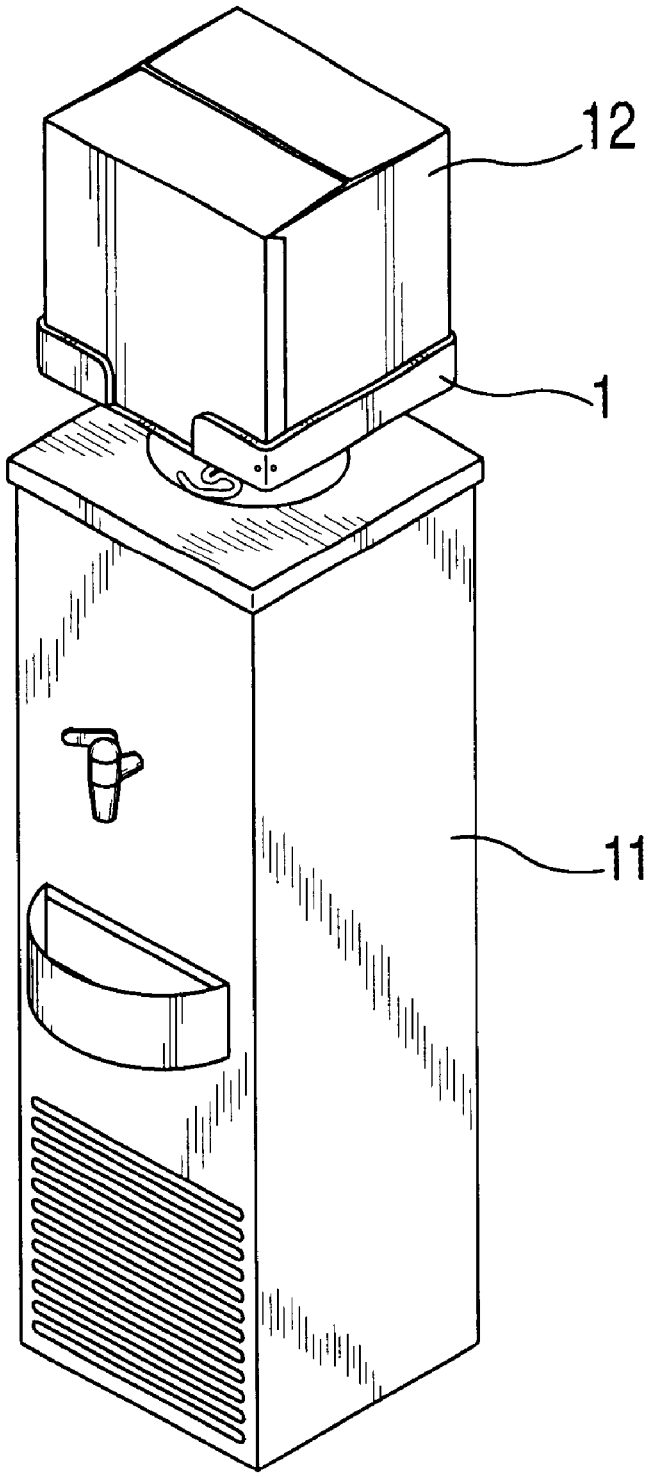

FIG. 1 is a perspective view of the adapter according to the present invention, FIG. 2 shows the adapter according to the invention seen from above, FIG. 3 is a vertical cut taken along line I—I in FIG. 2 for a preferred embodiment af the present invention, FIG. 4 is a vertical cut taken along line I—I of FIG. 2 for a second embodiment of the present invention, and FIG. 5 shows the adapter according to the present invention placed on the top of a combined cooler and dispenser unit.

DETAILED DESCRIPTION OF THE INVENTION

The adapter shown in FIGS. 1 and 2 comprises a support 1, which in the embodiment shown in the figures has a quadratic cross-section. The support 1 has vertical walls 2. The support 1 is intended to support a container containing a liquid. Centrally in the support 1 there is arranged a downwardly extending chamber 3 which is open against the bottom of the support 1. The support 1 and the wall of the chamber 3 has in one of their sides a coinciding opening 4 which is used when connecting a container placed on the support 1 to the combined cooler and dispenser as will be explained later. The chamber 3 has a lower part 5 with a bottom 6.

According to the preferred embodiment shown in FIG. 3, it is in the bottom 6 of the lower part 5 of the adapter that there is arranged a vertical pipe 7 connected to the bottom 6. The pipe 7 is closed at its upper end and has at its lower end a closable valve 8. On the outside of the upper part of the pipe 7 there is arranged a flange 9 which communicates with the inner part of the pipe 7. The pipe 7 is preferably affixed in an opening in the bottom 6 of the lower part 5 by means of a threaded nut or the like.

On FIG. 5 the adapter according to the present invention is placed on the top of a combined cooler and dispenser 11. A container 12 is placed in the support 1 of the adapter. The container 12 has a flexible inner container made from plastic (not shown) and contains a liquid such as water. The container 12 has a flexible hose affixed to its bottom, said hose communicating with the inner flexible container. By installing the container 12, the adapter is first mounted on the top of the combined cooler and dispenser 11. Thereafter the container 12 is placed in the support 1 of the adapter. Through the opening 4 in the wall of the chamber 3 of the adapter, the flexible hose is manually connected to the flange 9 on the vertical pipe 7. For the adapter according to the preferred embodiment shown in FIG. 3, the valve 8 in the bottom of the vertical pipe 7 will now be open and liquid can flow from the container 12 to the reservoir in the combined cooler and dispenser until the floating disk arranged in the reservoir closes the valve 8. Further liquid will thereafter only flow from the container 12 to the reservoir when liquid is being tapped from the combined cooler and dispenser and the floating disk then sinks down and opens the valve 8.

The embodiment shown in FIG. 4 is different from the preferred embodiment shown in FIG. 3 in that the vertical pipe 7 is vertically movable down through the bottom 6 of the lower part 5 of the adapter and in that the pipe 7 on the outside of its upper end has a collar 10 which prevents the pipe 7 from sliding completely through the bottom 6 in the lower part 5 of the adapter.

By use of the adapter shown in FIG. 4, the hose connected to the container 12 is connected to the flange 9 on the pipe 7 in the same way as described above in connection with the embodiment shown in FIG. 3. Thereafter the pipe 7 is manually moved downwardly through the opening in the bottom 6 of the lower part 5 of the adapter until the lower end of the pipe 7 is connected to the pipe system in the combined cooler and dispenser 11. Thereby a connection is obtained between the container 12 and the combined cooler and dispenser 11 and water can be tapped from the dispenser.

As the inner container in the container 12 is flexible, the inner container will collapse as water is being tapped from the container 12. Return air will thus not flow into the inner container and the possibility of transport of bacteria to the inner container is eliminated.

Even if the support 1 in the embodiments shown in the figures has a quadratic cross-section, it is within the scope of the present invention to have supports with different geometry, such as for instance rectangular shape, triangular shape or circular shape. The adapter according to the present invention makes its thus possible to use containers of different shapes on combined coolers and dispensers which originally were only made to support standard bottle-shaped containers.

What is claimed is:

1. An adapter for use in connection with combined coolers and dispensers for liquids, particularly drinking water, which coolers and dispensers are intended for receiving a bottle-shaped container placed bottom-up on the top of the combined cooler and dispenser, characterized in that the adapter comprises a support (1) for supporting a container (12) for a liquid, a chamber (3) extending downwardly from the support (1), said chamber (3) having an opening (4) in its wall, a lower part (5) with a bottom (6), a vertical pipe (7) arranged in the bottom (6) of the lower part (5) of the adapter, which pipe (7) is open or can be opened at its lower end and is closed at its upper end and which at its upper part has a flange (9) which is open towards the inside of the pipe (7), said flange (9) being intended to be connected to a flexible hose between the flange (9) and the container (12) which is to be placed in the adapter, and where the vertical pipe (7) is intended to communicate with the pipe system in the combined cooler and dispenser.

2. Adapter according to claim 1, characterized in that the vertical pipe (7) is rigidly affixed to the bottom (6) of the lower part (5) of the adapter, and that the lower part of the vertical pipe (7) is equipped with a closable valve (8).

3. Adapter according to claim 1, characterized in that the vertical pipe (7) is arranged vertical movable in the bottom part (6) of the lower part (5) of the adapter and where the vertical pipe (7) is intended to be moved downwards in vertical direction in order to connect the vertical pipe (7) to the pipe system in the combined cooler and dispenser.

4. Adapter according to claim 1, characterized in that the adapter is affixed to the combined cooler and dispenser by means of a mechanical fastening means in order to make sure that the adapter cannot move in relation to the combined cooler and dispenser.

5. Adapter according to claim 4, characterized in that the mechanical fastening means is a screw connection.

* * * * *